US005167993A

United States Patent [19]

Aoyagi

[11] Patent Number: 5,167,993

[45] Date of Patent: Dec. 1, 1992

[54] COLOR CHANGING TRANSPARENT PLATE DEVICE

[76] Inventor: Youhichiro Aoyagi, 1200-3, Ooazabeppu, Shimemachi, Kasuya-gun, Fukuoka, Japan

[21] Appl. No.: 486,244

[22] Filed: Feb. 28, 1990

[51] Int. Cl.[5] ..... E06B 3/24; G09F 19/00

[52] U.S. Cl. ..... 428/34; 428/13; 428/14; 428/18; 428/542.2; 52/788; 52/790; 40/406; 40/439; 40/446; 40/477

[58] Field of Search ..... 52/788, 790; 428/34, 428/13, 14, 192, 218, 542.2; 40/406, 517, 446, 422, 412, 477, 439

[56] References Cited

U.S. PATENT DOCUMENTS

| | | | |
|---|---|---|---|
| 4,044,519 | 8/1977 | Morin et al. | 52/304 |
| 4,093,352 | 6/1978 | Pisar | 52/171 |
| 4,686,784 | 8/1987 | Smithies | 40/406 |
| 4,768,315 | 9/1988 | Grimme | 52/2 |

*Primary Examiner*—Ellis P. Robinson

*Assistant Examiner*—Donald J. Loney

*Attorney, Agent, or Firm*—Bruce L. Adams; Van C. Wilks

[57] ABSTRACT

A color changing transparent plate device comprises transparent plates facing each other with a gap between the plates, the gap being charged with a plurality of fluids having colors and relative densities different from each other and freely moving vertically and a fluid inlet/outlet device through which fluid flows into or out from the gap installed in order to hold an interface of the fluids with freely moving vertically wherein the colorless transparent is contained as the color, wherein the fluid above the interface is a gas and the fluid below the interface is a liquid, wherein the fluids above and below the interface are liquids, wherein the liquids are a transparent liquid and an opaque liquid, wherein the liquids are a colorless transparent liquid and a colored transparent liquid, wherein a spacer is installed in the gap and the spacer and the facing transparent plates are attached, and wherein a fluid inlet/outlet device is formed by a fluid inlet/outlet cylinder and a piston.

7 Claims, 6 Drawing Sheets

COLOR CHANGING TRANSPARENT PLATE DEVICE

BACKGROUND OF THE INVENTION

1. Field of the Invention

The present invention relates to a transparent plate device whose color can be changed and which is used for window glasses and so on.

2. Description of the Related Art

Hitherto, the light passing through window glass has been shaded or shielded by the blinds for use in windows, curtains or the like.

SUMMARY OF THE INVENTION

An object of the present invention is to provide a color changing transparent plate device which can shade or shield light by freely changing its own color without using blinds or curtains.

To accomplish the above described object, a color changing transparent plate device of the present invention comprises transparent plates facing each other with a gap between the plates, the gap being charged with a plurality of fluids having colors and relative densities different from each other and freely moving vertically and a fluid inlet/outlet device through which fluid flows into or out from the gap installed in order to hold an interface of the fluids with freely moving vertically wherein the colorless transparent is contained as the color, wherein the fluid above the interface is a gas and the fluid below the interface is a liquid, wherein the fluids above and below the interface are liquids, wherein the liquids are a transparent liquid and an opaque liquid, wherein the liquids are a colorless transparent liquid and a colored transparent liquid, wherein a spacer is installed in the gap and the spacer and the facing transparent plates are attached, and wherein a fluid inlet/outlet device is formed by a fluid inlet/outlet cylinder and a piston.

Therefore, the interface 5 of fluids 2 and 3 having relative densities different from each other charged in a gap t can be raised or lowered by reciprocally operating a fluid inlet/outlet device 4. Light can be transmitted through the transparent plates 1 and 1 by pumping the colorless transparent fluid 3 having higher relative density which is positioned under the interface 5 into the whole face of the gap t to make the gap t transparent, or a part of the light can be absorbed or shielded by lowering the colored or opaque fluid 2 having lower relative density, which is positioned above the interface 5 into the gap t in order to lower the interface 5 by the fluid having lower relative density, as shown in FIG. 1. Furthermore, a part of the light can be absorbed from the whole face of the gap t or the light can be perfectly shielded and the directly projecting light can be avoided by the colored or opaque fluid 2 having lower relative density by lowering the interface 5 to the lowest position.

Although the fluid above the interface 5 can be a gas (air) and be opened to the atmosphere, the fluid below the interface should be a liquid. In this case, the liquid may be colored or be opaque since the air is colorless and transparent.

The liquids 2 and 3 above and below the interface 5 may also be the liquids having relative densities different from each other.

In addition, a colorless, colored or translucent liquid can be used as the liquid under the interface 5 and an opaque liquid can be used as the liquid on the interface 5.

Furthermore, a colorless transparent liquid and a colored transparent liquid can be used as the liquids on and under the interface 5.

The transparent plates 1 and 1 of both sides of the gap t are unified by the spacer 6.

The fluids 2 and 3 in the cylinder 7 are reciprocally flowed out from the both ends of the cylinder and are flowed into the upward and the downward of the gap t by sliding the piston 8 in the cylinder 7 by the human power (FIG. 5) or other power (FIG. 1).

A plurality of liquids 2 and 3 can be pumped out from or into the gap t by operating a pump 9 and a stop valve 10 in the above described cylinder 7.

Since the present invention is constituted as above described, it can be applied to the windows and can permit complete transmission of sunlight and perform partial shielding by permittiing partial transmission and complete shielding by partial shielding or complete nontransmission without using blinds or curtains to the window since it can freely raise or lower the interface 5 of the fluids in the gap t.

In addition, it can be used as a shop front or an advertising display board and can not only improve the displaying effect by the spacer 6' positioned at its center part but also be strengthened at the center part of the transparent plates 1 and 1 by the spacer 6' positioned at its center part and be enlarged.

Furthermore, it is also useful in sound insulation of window glass and so on.

DETAILED DESCRIPTION OF THE PREFERRED EMBODIMENTS

Figure 1:
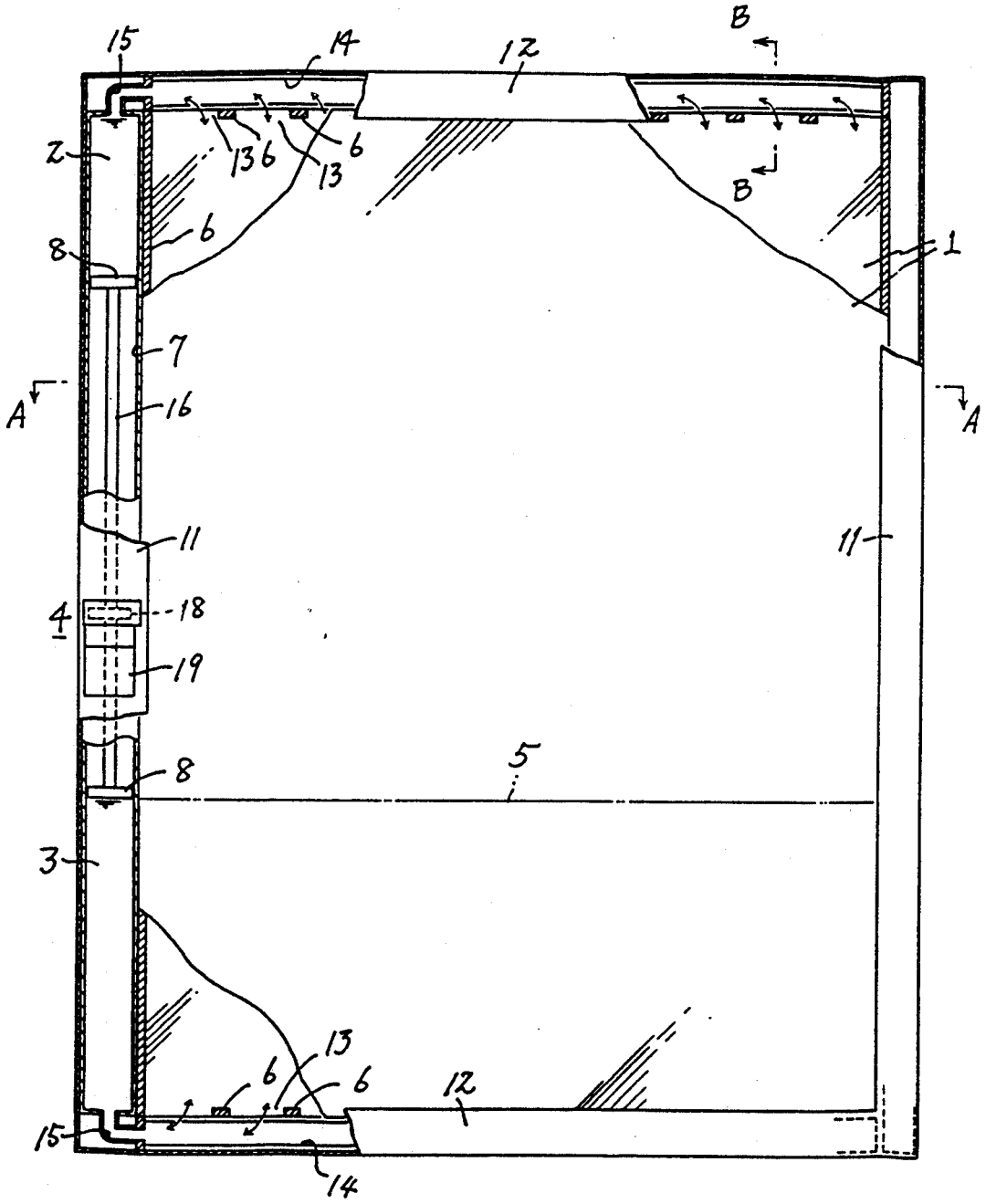
FIG. 1 is an elevational and broken view of a color changing transparent plate of the present invention.
Figure 2:
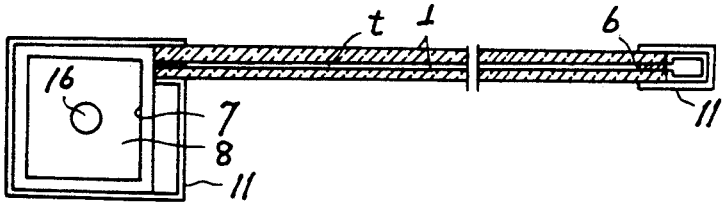
FIG. 2 is a transverse sectional view taken on line A—A of FIG. 1.
Figure 3:
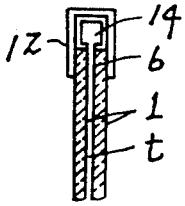
FIG. 3 is a vertical sectional view taken on line B—B of FIG. 1.
Figure 4:
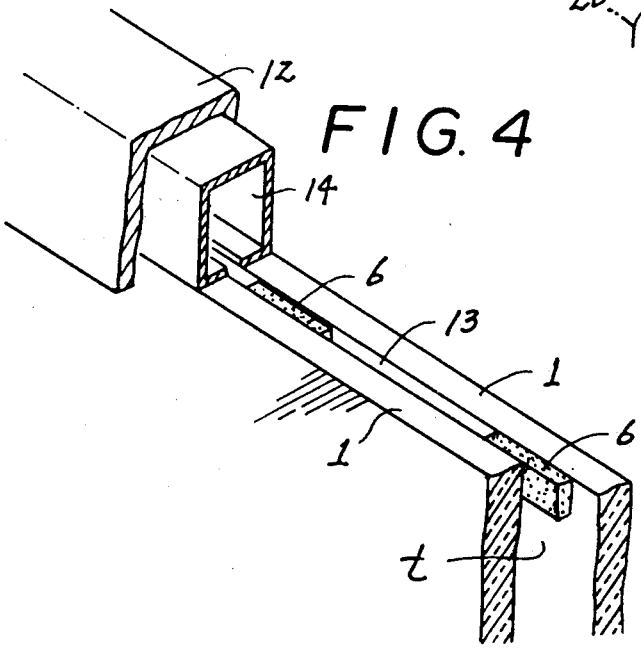
FIG. 4 is a cutaway view in perspective of an upper fluid passage.
Figure 5:
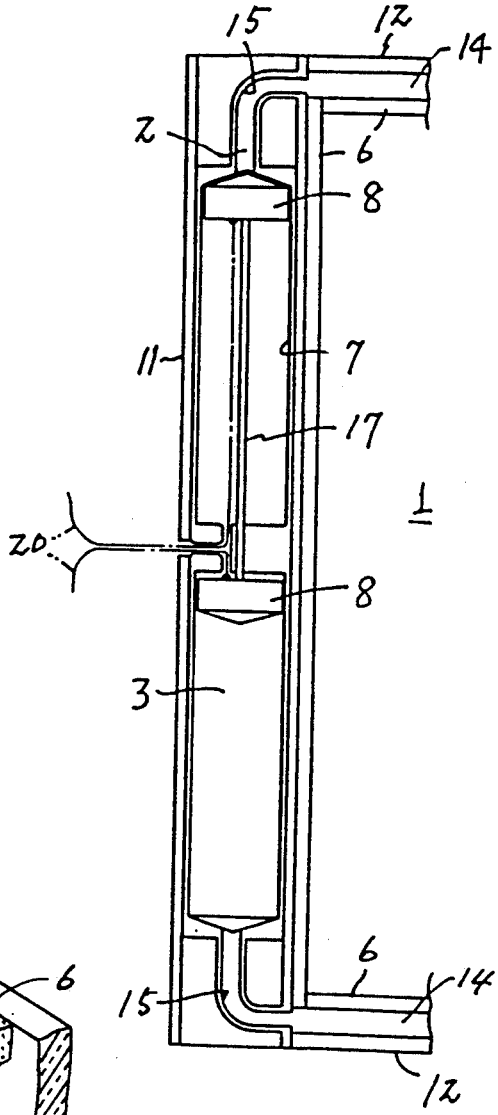
FIG. 5 is an elevational view of a manual fluid inlet/-outlet device.
Figure 6:
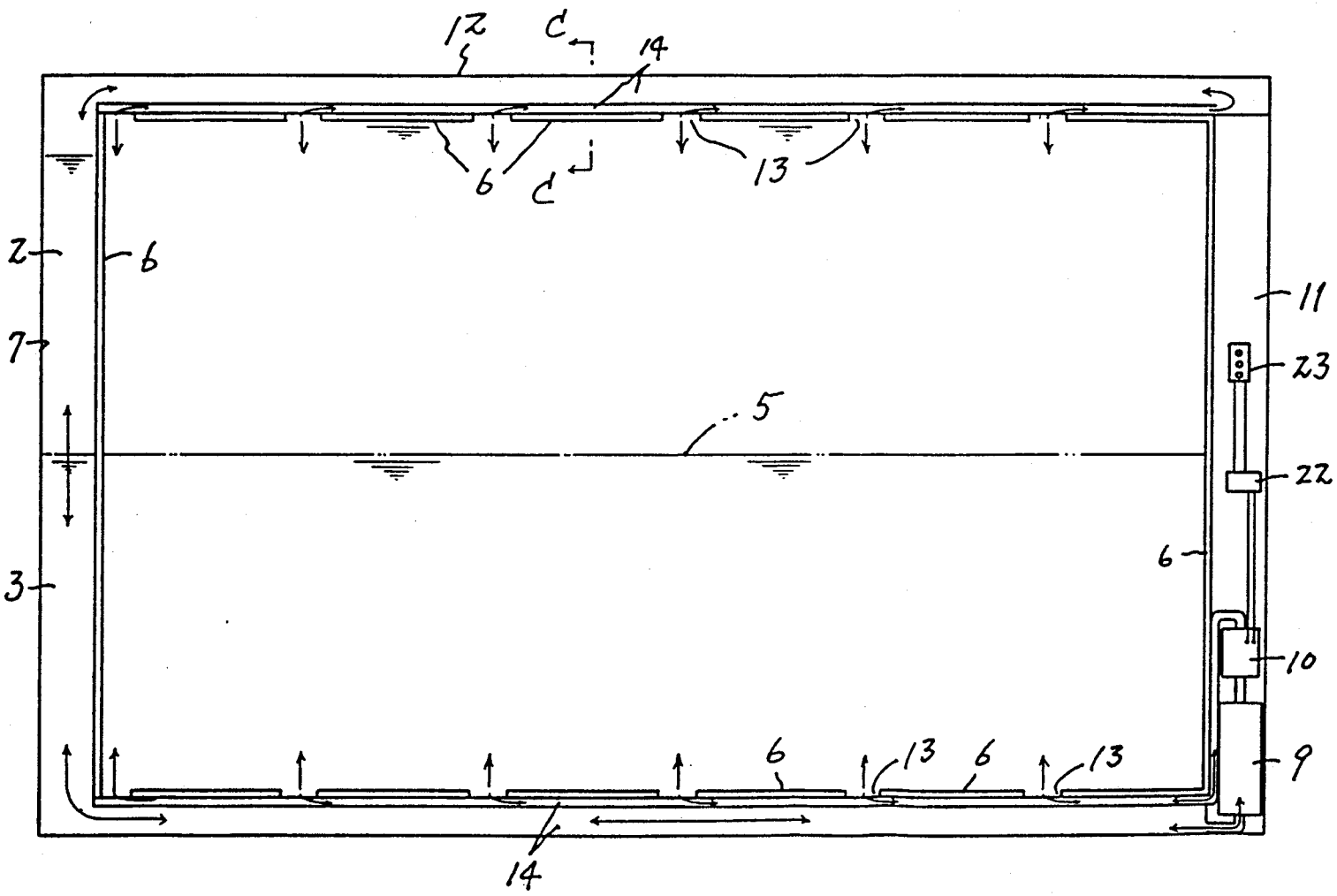
FIG. 6 is an elevational view of a color changing transparent plate having a pump fluid inlet/outlet device.
Figure 7:
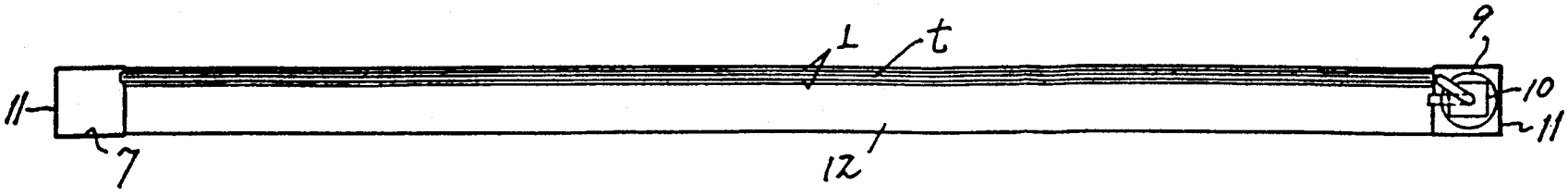
FIG. 7 is a top plan view of FIG. 6.
Figure 11:
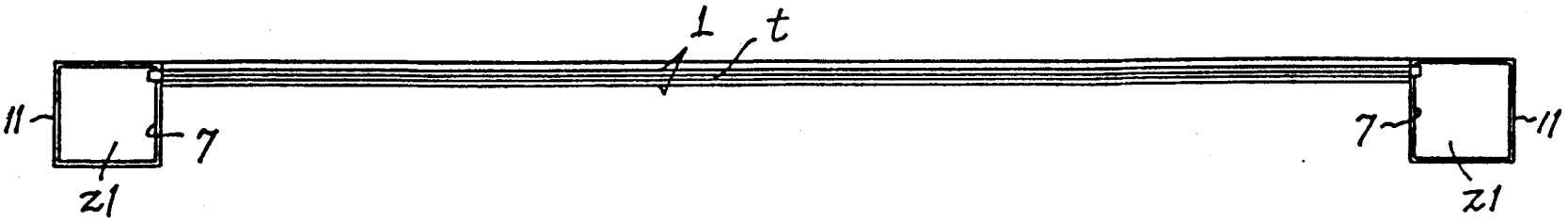
FIG. 11 is a top plan view of FIG. 10.
Figure 8:
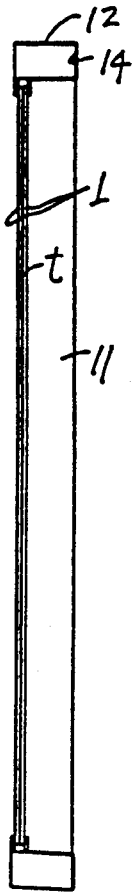
FIG. 8 is a transverse sectional side view of FIG. 6.
Figure 9:
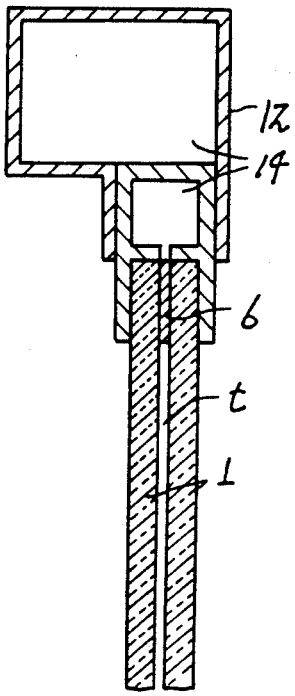
FIG. 9 is an enlarged transverse sectional side view taken on line C—C of FIG. 6.
Figure 12:
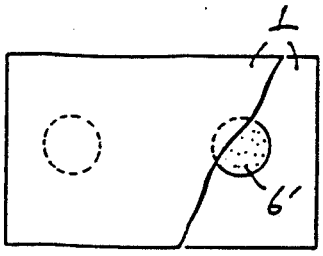
FIG. 12 is an elevational view of a central spacer.
Figure 13:
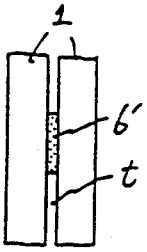
FIG. 13 is a side view of FIG. 12.
Figure 14:
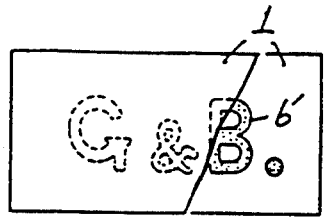
FIG. 14 is an elevational view of an advertisement spacer.
Figure 15:
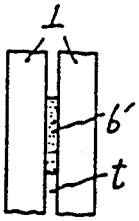
FIG. 15 is a side view of FIG. 14.
Figure 16:
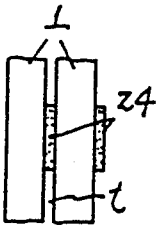
FIG. 16 is a side view of a color changing transparent plate for advertisement use.
Figure 17:
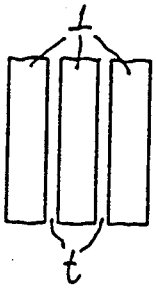
FIG. 17 is a side view of a color changing transparent plate having a plurality of gaps.
Figure 10:
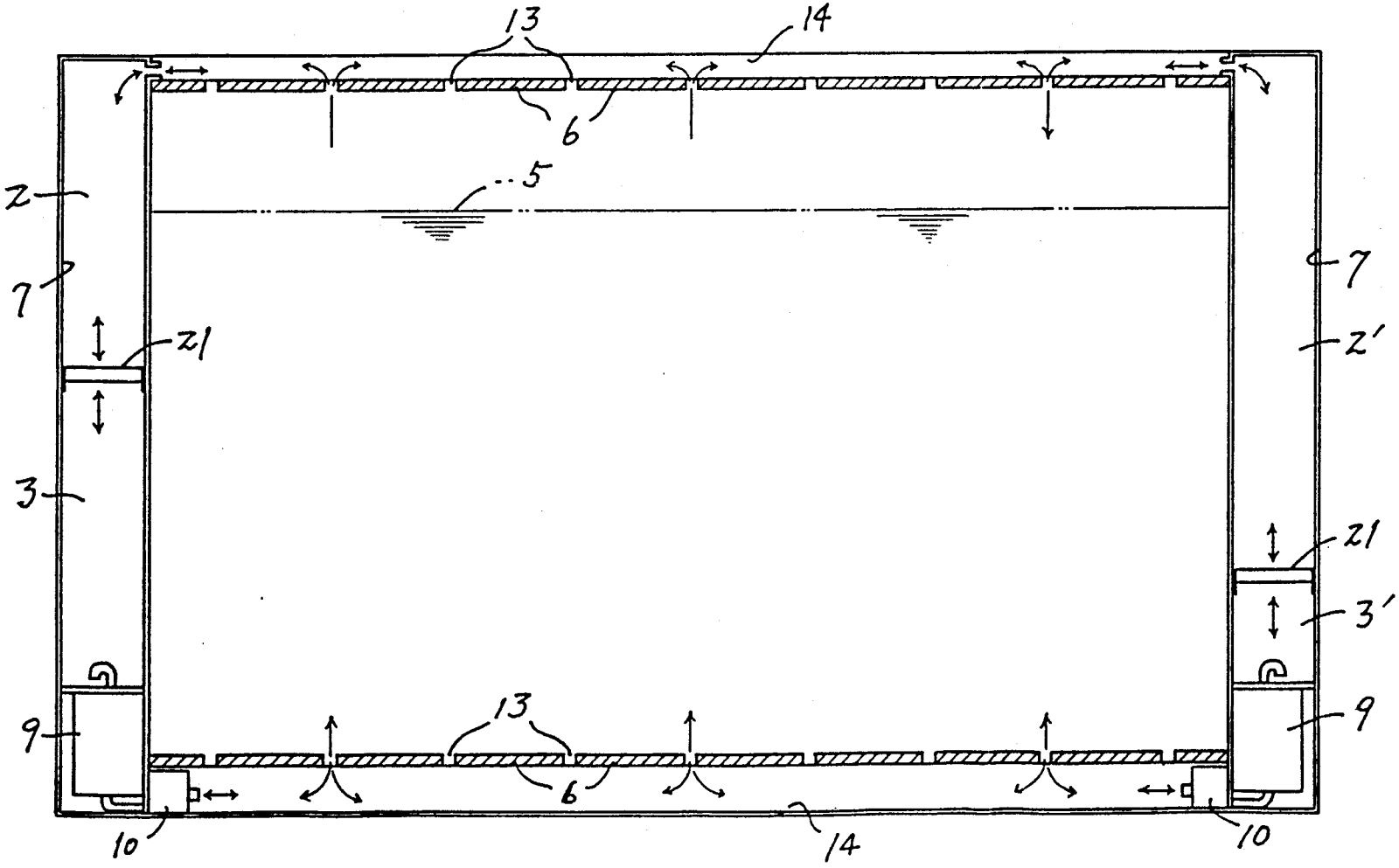
FIG. 10 is an elevational view of a color changing transparent plate whose color is changed by 4 kinds of fluids.

Transparent plates 1 and 1 made of synthetic resin or glass face each other through spacers 6 and 6 placed at both sides or at the top and bottom sides. A gap t of a thickness of 1 to 2 mm is formed by the spacers 6 and 6. As shown in FIGS. 12 to 15, the spacers 6' and 6' are laid between the central part of the transparent plates 1 and 1 and are attached to the transparent plates 1 and 1 using adhesives in order to strengthen the central part of the transparent plates 1 and 1 or to form the advertising copies, patterns and so on. The transparent plates 1 and 1 are surrounded by vertical frames 11 and horizontal frames 12 and a fluid inlet/outlet aperture 13 is formed at the upward and downward spacers 6 and 6 so that a fluid 2 can enter into or go out from the horizontal frame 12 where a fluid passage 14 is formed. The vertical frame 11 has a fluid inlet/outlet device 4 built-in. This fluid inlet/outlet device 4 connects the upper and lower ends of a fluid inlet/outlet cylinder 7 installed in the vertical frame 11 to fluid passages 14 and 14 in the upper and lower horizontal frames 12 and 12 through communicating tubes 15 and 15. Freely moving vertical pistons 8 and 8 are installed in the cylinder 7 and are connected to a screw rod 16 (FIG. 1) or a connecting rod 17 (FIG. 5) and a reciprocally rotating screw 18 is screwed to the screw rod 16. Thus, the screw rod 16 and the pistons 8 and 8 are raised or lowered by reciprocally rotating the screw 18 by means of a reciprocal motor 19. As shown in FIG. 5, cords 20 and 20 are pulled out from the vertical frame 11 in the connecting rod and they are formed so that the connecting rod 17 and the pistons 8 and 8 are raised or lowered by pulling one of the cords 20 and 20 by hand. As shown in FIG. 10, a pump 9 and an electromagnetic stop valve 10 are connected to fluid inlet/outlet cylinders 7 and 7 in the vertical frames 11 and 11 of both sides. These cylinders 7 and 7 are connected to a fluid passage 14 installed in the horizontal frame 12 of the lower part through the pump 9 and the stop valve 10. Two kinds of fluids 2 and 3, and 2' and 3' are charged in cylinders 7 and 7 and a float valve 21 is placed at the interface of the fluids 2 and 3 and the interface of the fluids 2' and 3'. The relative density of the float valve 21 used is intermediate between the relative densities of those of the fluids in 2 and 3, and 2' and 3'. In FIGS. 1 and 5, the fluid having lower relative density (liquids containing oils and fats, for example, lamp oil, lamp oil milky liquid, and so on) is charged from the upward piston 8 and the top face of the cylinder 7 to about the middle part of the gap t through the upward fluid passage 14 and the fluid having higher relative density (water, boric acid solution, salt water, water glass, silicone oil, mercury and so on) is charged from the downward piston 8 and the bottom face of the cylinder 7 to about the middle part of the gap t through the lower fluid passage 14. Specifically, silicone oil is preferable because it has very low surface tension and its heat-resistance, cold-resistance, electrical insulation resistance and so on and does not change in the range −40° C. to +200° C. A liquid which is mixed with glycol or the like so that it is nonflammable, nonfreezing and nonseptical, and does not contain photochemically altering material (Algae), is suitable for the above described liquid 2 and 3. Both above described liquids 2 and 3 consist of a colorless transparent liquid and a colored transparent or opaque liquid, and various colorings can be made so as to shield or provide an advertising display. A total of four kinds of liquids 2, 3, 2' and 3' which have colors and relative densities different from each other can be sent to the gap t by charging two kinds of liquids 2 and 3, and 2' and 3' which have colors and relative densities different from each other upward and downward in the respective float valves 21 and 21 as shown in FIG. 10. These four kinds of liquids 2, 3, 2' and 4' having colors different from each other can be inserted into the gap t through three interfaces 5. The fluids contain not only liquid but gas, but the interface 5 would not be straight and would become obscure when only gases having relative densities different from each other are used. In addition, dry air and liquid may be used for the fluids above and below the interface 5, respectively. As shown in FIG. 17, a plurality of gaps t can overlap each other and various colors can be created by harmonizing the colors of the fluids in respective gaps t and t. In FIG. 6, a reference number 22 denotes a control circuit consisting of IC and 23 denotes switch. In Fig. 16, a reference number 24 denotes a scotch(**) (trademark) for use in public notice.

What is claimed is:

1. A color changing transparent plate assembly comprising:

transparent plates facing each other with a gap between said plates;

at least two liquids having different color characteristics and different relative densities contained in said gap each on a side of a substantially rectilinear interface and free to move up and down; and means to output or input said liquids from or into said gap and to hold said interface of said liquids freely movable up and down.

2. A color changing transparent plate assembly according to claim 1 wherein one of said liquids is a colorless transparent liquid.

3. A color changing transparent plate assembly according to claim 1, wherein said liquids comprise a transparent liquid and an opaque liquid.

4. A color changing transparent plate assembly according to claim 1, wherein said liquids comprise a colorless transparent liquid and a colored transparent liquid.

5. A color changing transparent plate assembly according to any one of claims 1 or 2, wherein a space is disposed between said plates in said gap and said spacer is adhered to said facing transparent plates.

6. A color changing transparent plate assembly according to any one of claims 1 or 2, wherein said means includes a fluid inlet/outlet cylinder and a piston.

7. A color changing transparent plate assembly according to any one of claims 1 or 2, wherein said means includes a pump connected to a fluid inlet/outlet cylinder and a stop valve.

* * * * *